US005692747A

United States Patent [19]

Guerrero et al.

[11] Patent Number: 5,692,747

[45] Date of Patent: Dec. 2, 1997

[54] COMBINATION FLIPPER SORTER STACKER AND MAIL BOX FOR PRINTING DEVICES

[75] Inventors: Marco A. Guerrero; Ernesto Solis; Heriberto Guzman, all of Guadalajara, Mexico

[73] Assignee: Hewlett-Packard Company, Palo Alto, Calif.

[21] Appl. No.: 431,334

[22] Filed: Apr. 27, 1995

[51] Int. Cl.[6] ..... B65H 29/60

[52] U.S. Cl. ..... 271/296; 271/291

[58] Field of Search ..... 271/296, 287, 271/288, 291, 298, 300, 302, 303, 65, 306, 193, 314, 901; 198/373, 381, 395, 401, 402, 403, 406, 407, 408, 411, 412, 416

[56] References Cited

U.S. PATENT DOCUMENTS

| | | | |
|---|---|---|---|
| 3,638,937 | 2/1972 | Schulz et al. | 271/296 X |
| 3,848,868 | 11/1974 | Stemmle | 271/296 X |
| 3,944,217 | 3/1976 | Greene et al. | 271/173 |
| 4,040,616 | 8/1977 | Clarkson et al. | 271/65 |
| 4,078,789 | 3/1978 | Kittredge et al. | 271/65 |
| 4,285,508 | 8/1981 | Kaneko | 271/291 X |
| 4,315,621 | 2/1982 | Snellman | 271/296 |
| 4,817,934 | 4/1989 | McCormick et al. | 271/296 |
| 5,092,579 | 3/1992 | Tokoro et al. | 271/291 X |

FOREIGN PATENT DOCUMENTS

| | | | |
|---|---|---|---|
| 288881 | 11/1988 | European Pat. Off. | 271/296 |
| 3516746 | 11/1985 | Germany | 271/296 |
| 140451 | 11/1980 | Japan | 271/296 |
| 190154 | 10/1984 | Japan | 271/296 |
| 2059396 | 4/1981 | United Kingdom | 271/296 |
| 9113018 | 9/1991 | WIPO | 271/296 |

*Primary Examiner*—Frank E. Werner
*Attorney, Agent, or Firm*—Anthony J. Baca

[57] ABSTRACT

A sheet sorting apparatus for depositing a sheet from a printer in one of a plurality of output trays. The apparatus has a pair of rollers that moves the sheet, leading edge first, out of the printer. As the sheet exits the rollers, it encounters a deflector. Depending on the position of the deflector, the sheet either moves into a first output tray or to a flipper assembly. The flipper assembly inverts the sheet so that trailing edge of the sheet exits the flipper assembly before the leading edge of a sheet. A continuous belt removes the sheet from the flipper assembly trailing edge first. Finally, a distribution head, which is movable along the continuous belt, is positioned adjacent to the one of a plurality of output trays prior to the arrival of the sheet. The distribution head then removes the sheet from the belt and directs it to the output tray.

7 Claims, 21 Drawing Sheets

COMBINATION FLIPPER SORTER STACKER AND MAIL BOX FOR PRINTING DEVICES

TECHNICAL FIELD

This invention relates generally to material handling devices and more particularly to an apparatus for flipping, sorting and stacking of a media.

BACKGROUND OF THE INVENTION

Within the printing and photocopying industries there has been a great need for various types of sheet handling equipment. Numerous inventions, created in an attempt to meet that need, have been disclosed in issued patents. Most disclosures use various configurations of conveyor belts, pinch rollers, deflector mechanisms and input and output trays. Many of these inventions address the problems caused by the increased speed of copy producing machines where slight differences in the positioning and design of these features often dramatically change the effectiveness of the invention as a whole.

Smaller collators and sorters intended for the office market are not generally exposed to high speed copy producing machines. Thus, in the office environment cost, simplicity, and ease of maintenance are more important factors for the collators than speed.

From the standpoint of photocopiers and printing devices, it is highly desirable at the end of the operation to have the output stacked in a particular sequential order. In most machines the order in which the output is delivered to the respective receiving tray is dependent upon the initial sequence and type of print job. It would, therefore, be advantageous to have a machine which supplied the output in a selected order independent of the order in which the originals entered the machine.

In many photocopiers and printing devices the several pages of printed sequence are delivered from the printer onto a stack with the first page of the sequence face down at the top of the stack or face up at the bottom of the stack. Consecutive sheets are stacked in the same inverse order below or above the first page. Manual inversion of the stack per se will not correct the inverse orientation. Each sheet in the stack must be individually inverted to obtain proper consecutive orientation between the pages. By eliminating this need for manually rearranging the sheets one saves time and therefore reduces overhead and the likelihood of error.

SUMMARY OF THE INVENTION

In order to accomplish the present invention, there is provided a sheet sorting apparatus for depositing a sheet from a printer in one of a plurality of output trays. The apparatus has a pair of rollers that moves the sheet, leading edge first, out of the printer. As the sheet exits the rollers, it encounters a deflector. Depending on the position of the deflector, the pair of rollers move the sheet into either a first output tray or a flipper assembly.

The flipper assembly inverts the sheet so that trailing edge of the sheet exits the flipper assembly before the leading edge. A continuous belt removes the sheet from the flipper assembly trailing edge first. Finally, a distribution head, which is movable along the continuous belt, is positioned adjacent to the one of a plurality of output trays prior to the arrival of the sheet. The distribution head removes the sheet from the belt and directs it to the output tray.

BRIEF DESCRIPTION OF THE DRAWINGS

A better understanding of the invention may be had from the consideration of the following detailed description taken in conjunction with the accompanying drawings in which.

DETAILED DESCRIPTION OF THE PREFERRED EMBODIMENTS

Figure 1:
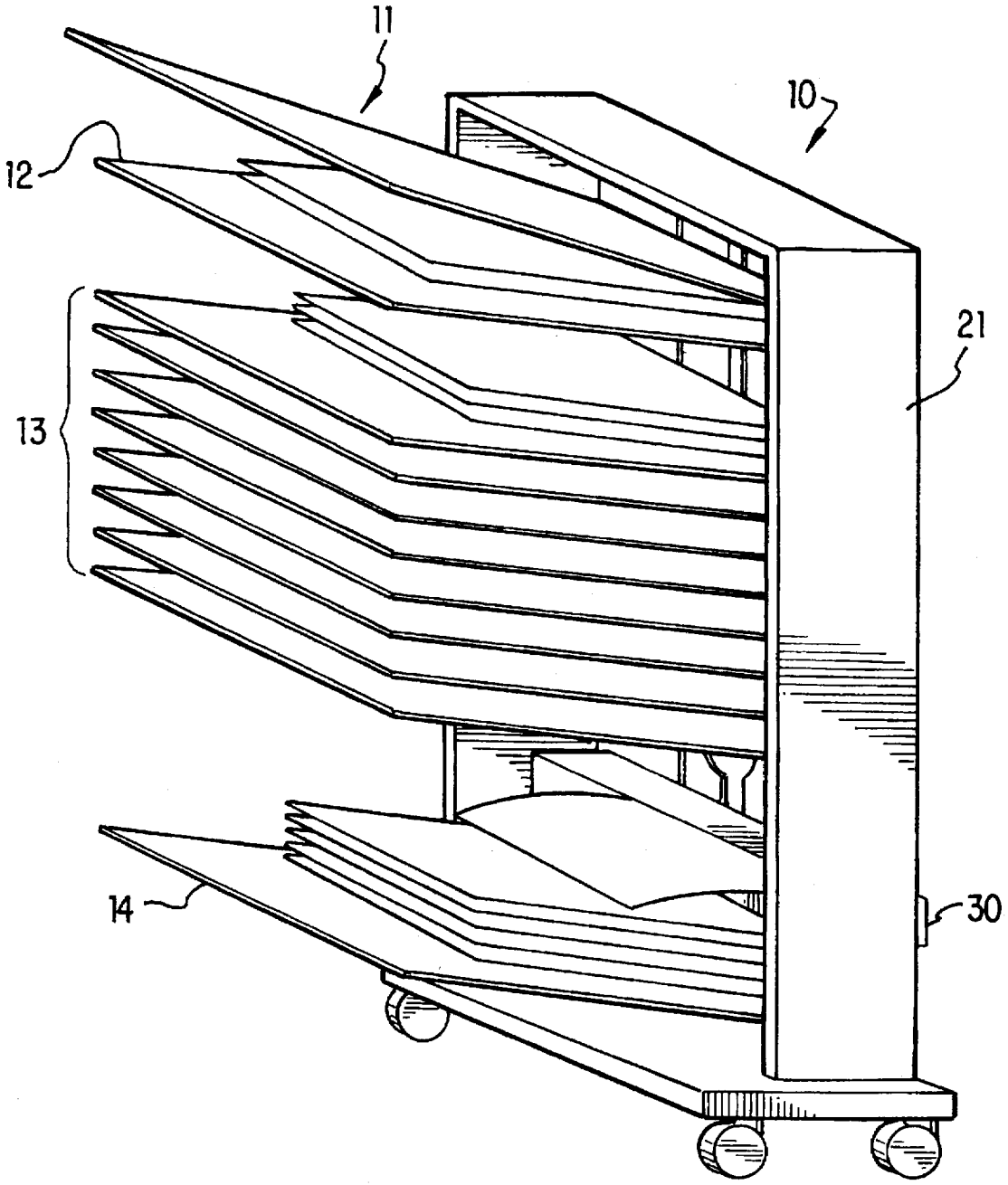
FIG. 1 is a perspective view showing the ornamental and architectural aspects of a preferred embodiment of the present invention.

The present invention is not limited to the specific embodiment illustrated herein. Referring particularly to FIG. 1, there is shown one example of a plural mode sheet output system 10. The disclosed embodiment of FIG. 1 allows for a plurality of destinations for the media. Namely, media may be delivered in a face up manner in the face up tray 12. It may be sorted and collated in the face down trays 13 or deposited in the stacker 14. For sheet inversion, flipper 11 is used.

The flipper-sorter-stacker-mailbox system 10 (herein referred to as FSSM) of FIG. 1 can be best described as four different systems integrated into one. Flipper 11 is responsible for taking the media leaving a printer (not shown) and either passing it to the face up tray 12 or flipping (or inverting) it to be stacked in the face down trays 13 or 14. The transportation system moves media from the flipper 11 through the device until it reaches the distribution head 30. Distribution head 30 extracts the media from the transportation system and feeds it to the designated output tray. A moveable head system ensures that distribution head 30 is properly located adjacent to the destination tray prior to the arrival of the media. Each one of these subsystems is described in greater detail below.

As media exits the printer it enters the FSSM 10 which then directs the media to the designated destination. As will be described in greater detail, media may simply be deposited in face up tray 12. If on the other hand the final destination is either the face down trays 13 or stacker 14 the media must take a more complicated route in reaching those destinations. Viewing this route at a high level, basically the media must first enter flipper 11 to ensure proper orientation. Next, media travels down transportation system arriving at distribution head 30. Distribution head 30 must already be located vertically along frame 21 at the designated output. When the media encounters distribution head 30 the media's direction of travel is transferred from vertical to essentially horizontal. FIG. 1 shows distribution head 30 located for distribution of media into stacker 14.

Figure 2:
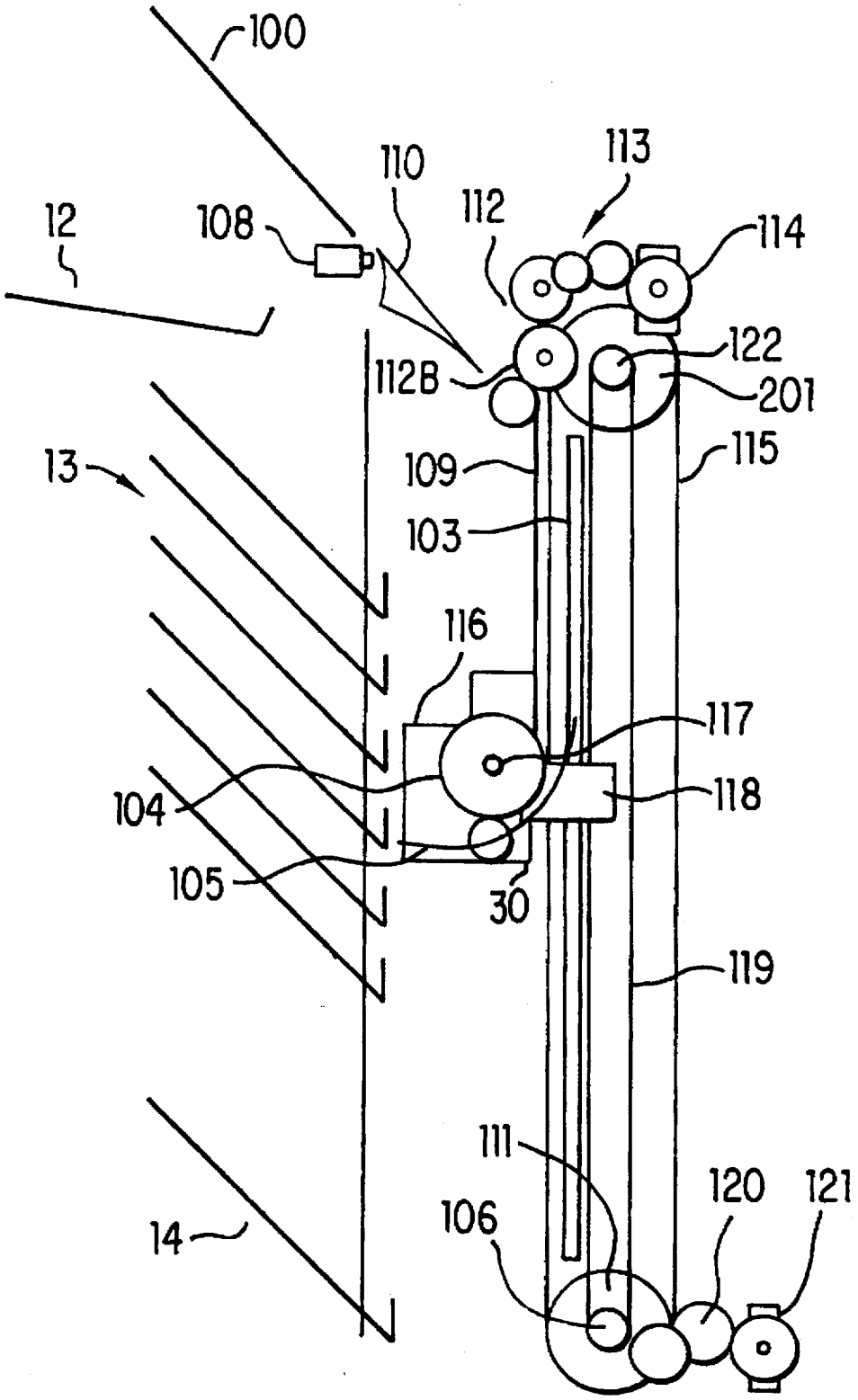
FIG. 2 is a simplified drawing showing the major mechanical components in accordance with the present invention.

With that macro vision of the preferred embodiment of FIG. 1 a more detailed description using subsequent figures will now follow. Referring now to FIG. 2 where the media path and associated manipulators are shown. As stated earlier distribution head 30 must be movable along the vertical axis. This movement is accomplished by the combination of timing belt 119, gear train 120 and motor 121. Motor 121 under influence of external control not shown in FIG. 2 transmits rotational energy through gear train 120 wherein timing belt 119 is rotated about shaft 106 and shaft 122. Distribution head 30 is rigidly attached via holding bracket 118 to timing belt 119. Rotational displacement of timing belt 119 causes a vertical displacement of distribution head 30. Thus, by controlling motor 121 the lateral placement of distribution head 30 can be manipulated.

One skilled in the art will understand that a controller is necessary to orchestrate the proper operation of the FSSM. Such a controller may take the form of a microcomputer. Other less desirable implementations might include dedicated logic circuit or mechanical switches. It is possible that the attached printing device provide all necessary control to insure proper sequencing of the FSSM operation.

Motor 114, through gear train 113, rotates rollers 112 and continuous transportation belt 115. Rollers 112 in combination with deflector 110, solenoid 108 and support tray 100 form the flipper 11. Assuming a counter clockwise rotation of pulleys 201 and 111, media travels with transportation belt 115 from rollers 112 to distribution head 30.

Figure 3:
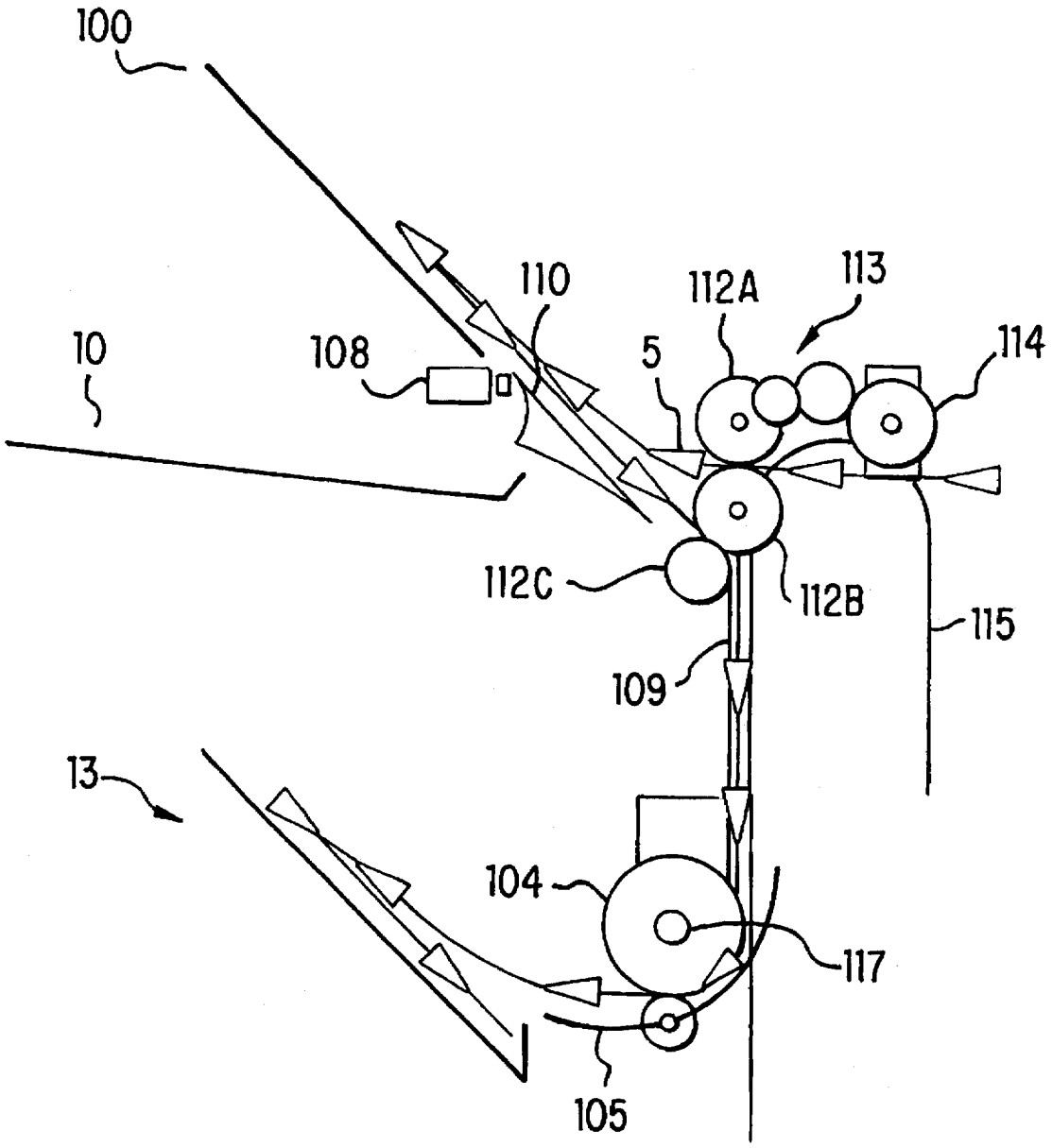
FIG. 3 shows the media path for face down operation.

Referring now to FIG. 3. As media exits the printer and enters the FSSM, rollers **112*a* and 112*b* direct the media towards deflector 110. As shown here solenoid 108 has positioned deflector 110 such that media 5 enters paper slider tray 100. Rollers 112*a* and 112*b* push media 5 up support tray 100 until the end of media 5 exits the nip of rollers 112. Once media 5 has escaped the influence of rollers 112, gravity forces media back into the nip of rollers 112*b* and 112*c*. Here, media 5 is forced between magnetic tape 109 and transportation belt 115. Referring briefly back to FIG. 2 one should note the location of magnet 103 behind transportation belt 115. Because of the location of magnet 103, magnetic tape 109 is attracted in a direction towards transportation belt 115 sandwiching media 5 between the two. Transportation belt 115, having a generally downward direction, transports media 5 from roller 112 to distribution head 30. Distribution head 30 receives media 5, and with the aid of roller 104 and deflector 105, routes media 5 to the final destination face down tray 13**.

Figure 4:
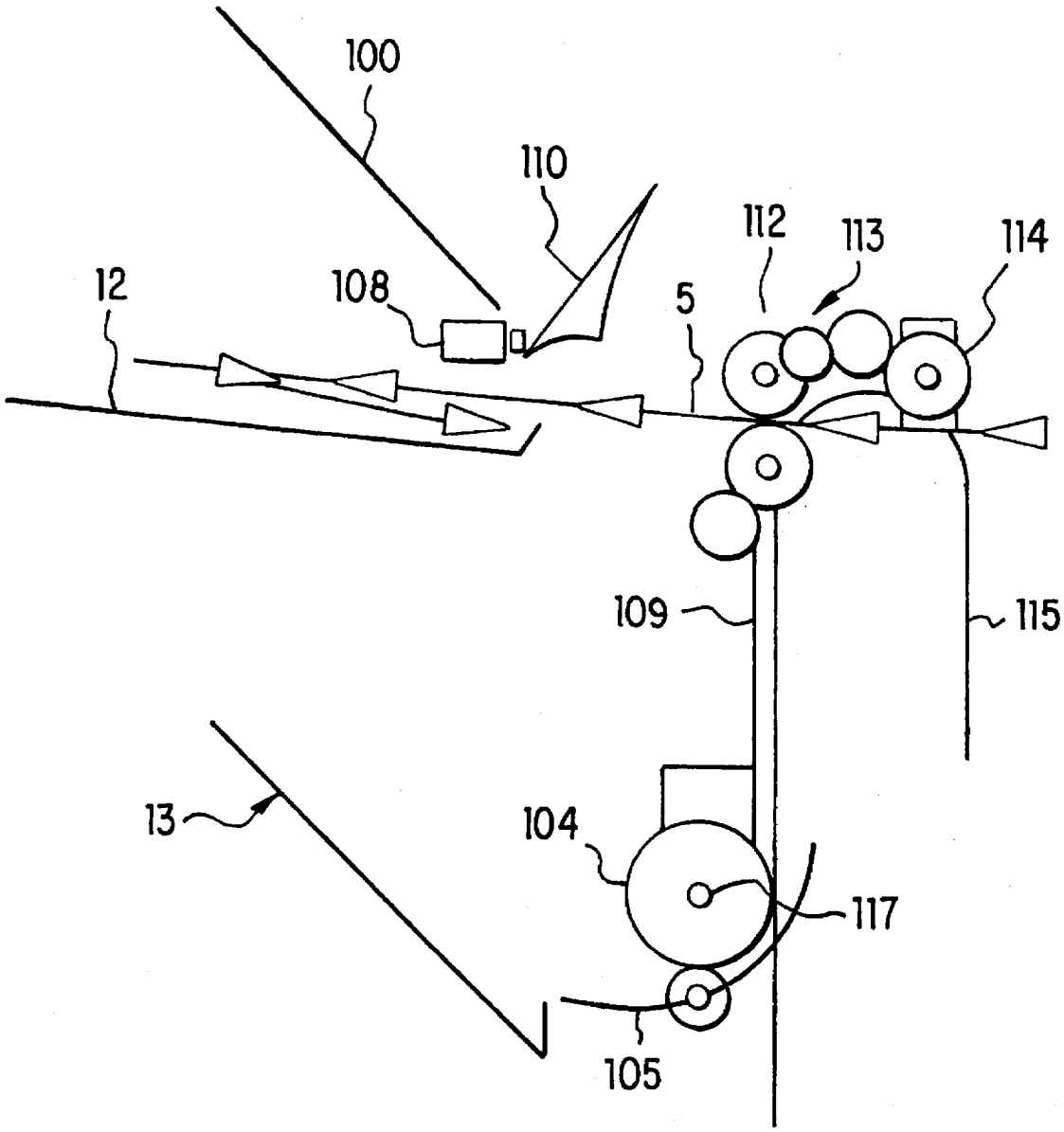
FIG. 4 shows the media path for face up operation.

Should it be desirable to deposit the media in a face up arrangement, the configuration of FIG. 4 can be used. Again, as media 5 exits printer it enters rollers 112. Here solenoid 108 is activated such that deflector 110 is removed from the paper path allowing media 5 to pass directly into face up tray 12.

Figure 5:
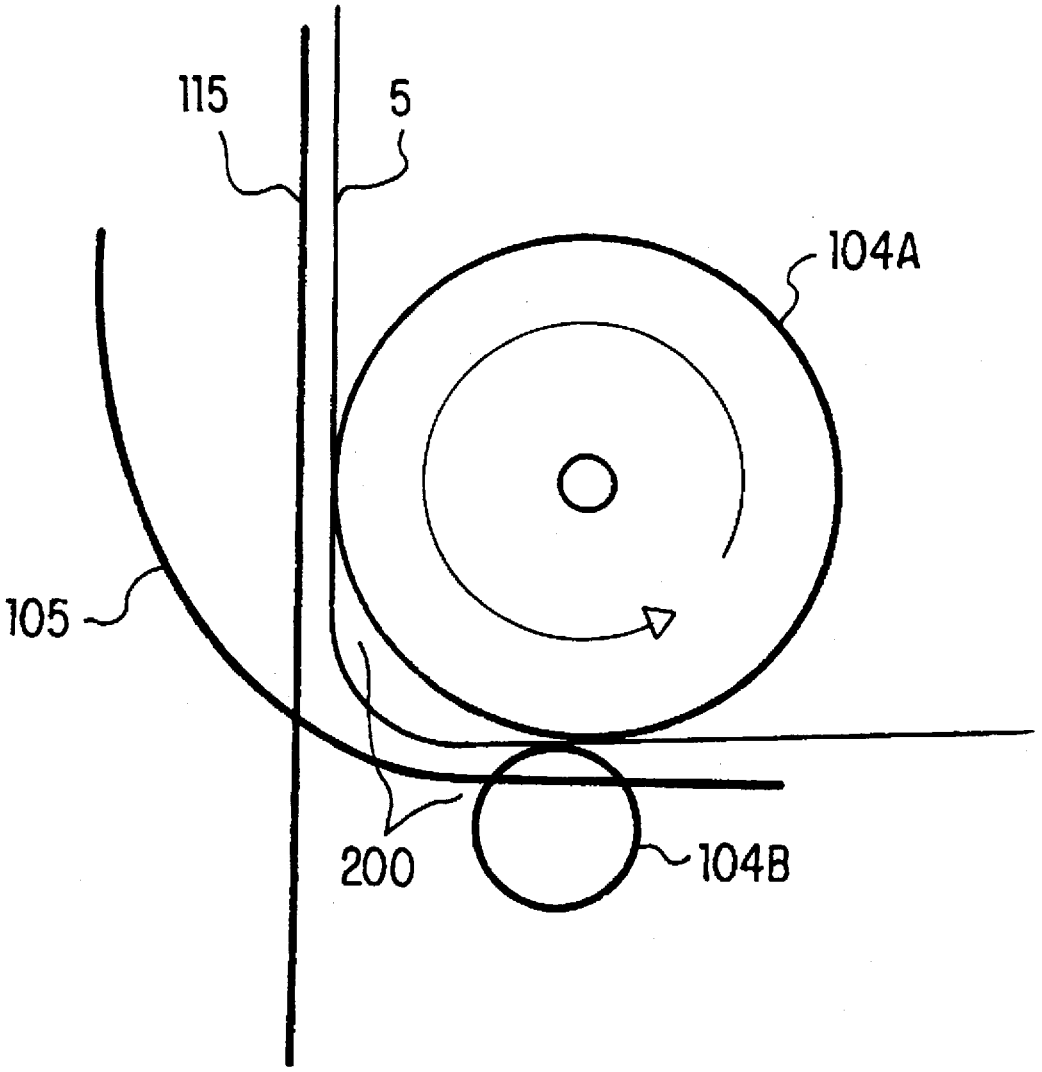
FIG. 5 is a simplified representation of the distribution head.
Figure 6:
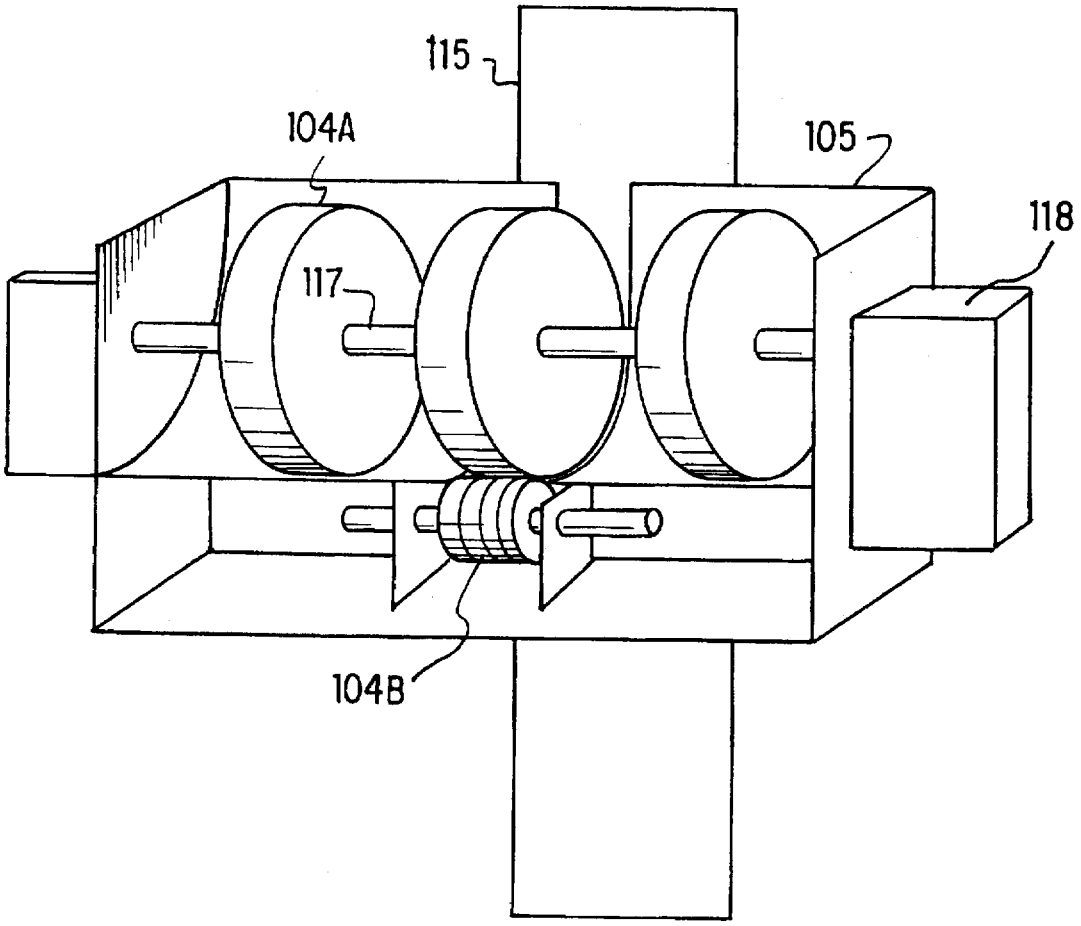
FIG. 6 is a perspective view of the distribution head.

Distribution head 30 is responsible for taking the media from the transportation belt 115 and moving it into the destination tray. To ensure proper media handling it is required that distribution head 30 be in place prior to media 5 reaching it. This assures that media 5 has a continuous movement from the exit of the printer to its final destination. Distribution head 30, as shown in FIGS. 5 and 6, consists of four rollers **104*a* and 104*b*, deflector 105 and housing not shown. In the preferred embodiment upper rollers 104*a* are spring loaded in order to maintain contact with transportation belt 115. By doing so, the transportation belt 115 imparts the rotational motion of upper rollers 104*a*** thereby eliminating the necessity of a motor to rotate the distribution head rollers.

Once media 5 reaches distribution head 30 it becomes sandwiched between upper rollers **104*a* and transportation belt 115. As media 5 continues its generally downward travel it eventually contacts deflector 105. By proper arrangement of deflector 105 the media's 5 direction is transposed to a generally horizontal direction. Next media 5 enters the nip between upper rollers 104*a* and lower roller 104*b*. At this point media 5 now has two driving forces exerted against it. Assuming the distribution head 30 has been properly located next to the destination tray, media 5 will eventually exit the nip between upper rollers 104*a* and lower roller 104*b*** to be deposited in the destination tray.

Holding brackets 118 are used to transport distribution head 30 vertically. These holding brackets, as stated earlier, are rigidly attached to timing belt 119. Briefly referring to FIG. 8 may aid the reader in understanding the mechanical configuration and differentiation between timing belts 119 and transportation belt 115.

Figure 7A:
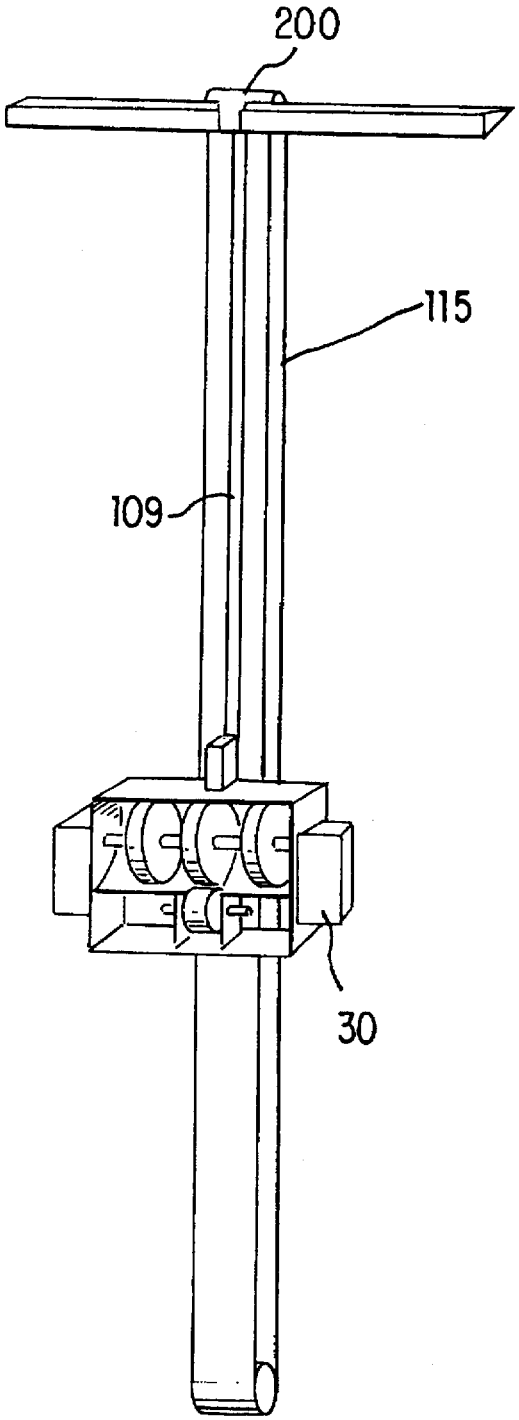
FIG. 7 shows additional detail of the transportation system.
Figure 7B:
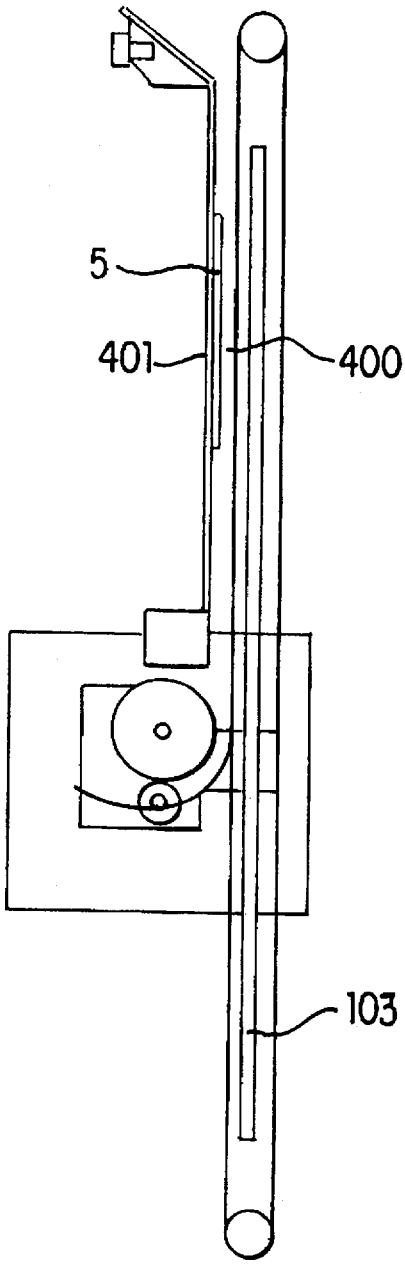

The transportation system of FIG. 7 is responsible for moving the media from the flipper 11 to distribution head 30. In the present embodiment it consists of a transportation belt 115 with a high coefficient of friction such that when media 5 is in contact with a transportation belt 115 media 5 is transported by transportation belt 115. Placed in front of media is a magnetic tape 109 which has a low coefficient of friction. The purpose of the magnetic tape 109 is to support media 5 and exert a lateral force against transportation belt 115. Magnetic tape 109 does not move with transportation belt 115 thus, requiring the low coefficient of friction.

While the present embodiment discloses and uses a magnetic tape and associated magnet 103 other arrangements are possible. For example, one such embodiment may use a vacuum system to create a negative pressure inside of transportation belt 115. By making transportation 115 porous, media 5 is then held against transportation belt 115 by the vacuum.

Returning to FIG. 7, magnetic tape 109 is retractably attached to distribution head 30. Additionally magnetic tape 109 is permanently anchored to tape anchor 200. With this arrangement as distribution head 30 is transported vertically, magnetic tape 109 is uncoiled to cover the present media path. Thus, magnetic tape 109 unrolls when distribution head moves down. In a similar manner when distribution head 30 moves up magnetic tape 109 rolls up. This arrangement significantly reduces magnetic tape 109 motion relative to media 5.

Figure 8A:
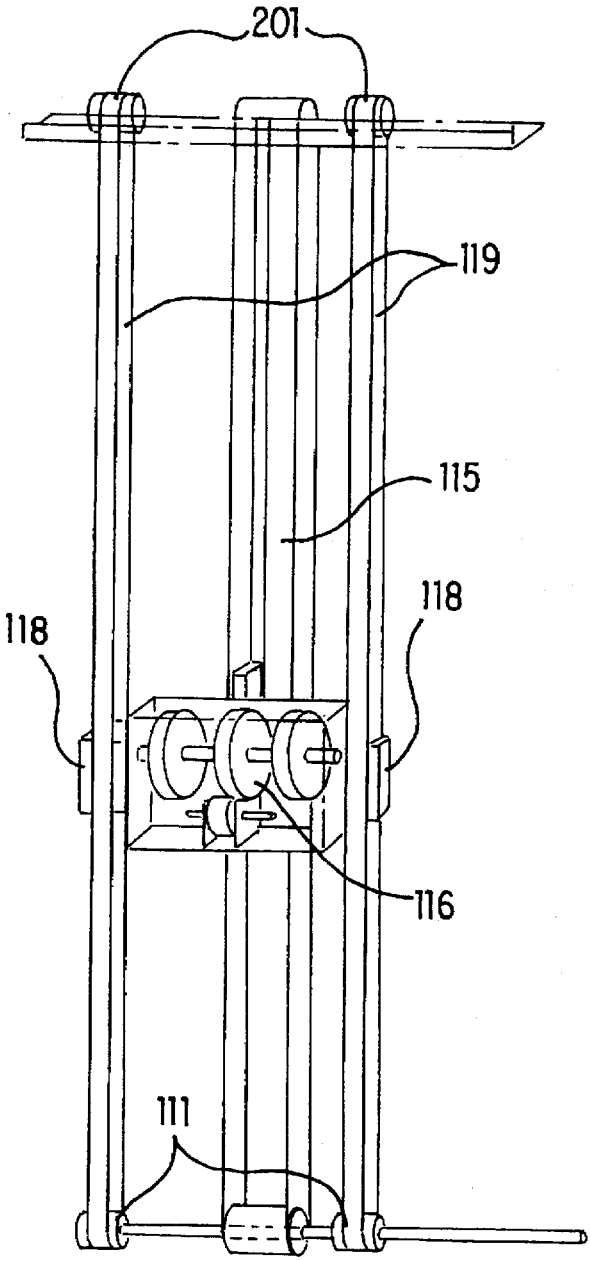
FIG. 8 is a more detailed perspective view showing the relationship of the media transportation system and the distribution head movement system.
Figure 8B:
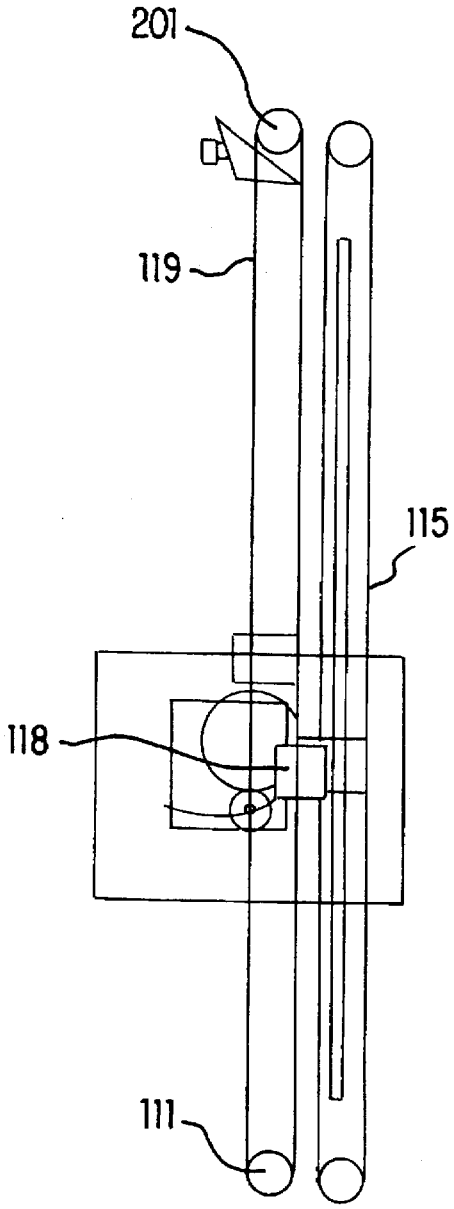

The head moving system of FIG. 8 is responsible for moving the distribution head 30 to the destination tray position. It consists of a pair of holding brackets 118 attached to the distribution head 30. These brackets in turn are connected to a pair of timing belts 119, where one belt is located on each side of the distribution head 30. Timing belts 119 are moved by four pulleys; two on top and two on the bottom. The two pulleys on top 201 are idle and held in place by a pair of pins which are attached to frame 20. Pulleys 111 on the bottom are connected together through a shaft 106 thus, ensuring synchronized movement of the two pulleys. Shaft 106 in turn is connected through gear train 120 to motor 121 such that when motor 121 rotates in one direction distribution head 30 moves in an upward direction, and in a similar manner, by rotating motor 121 in the opposite distribution head 30 will move in a downward direction.

While the disclosed embodiment uses two motors namely motor 114 and motor 121 wherein motor 114 powers feeding rollers 112 transportation belt 115 and roller 104 in the distribution head 30 and motor 121 operates timing belt 119, it is possible that the embodiment of FIG. 2 could eliminate motor 121. By using, for example, an electromagnetic clutch and gear train system to move the distribution head 30, motor 121 is not necessary.

Figure 9:
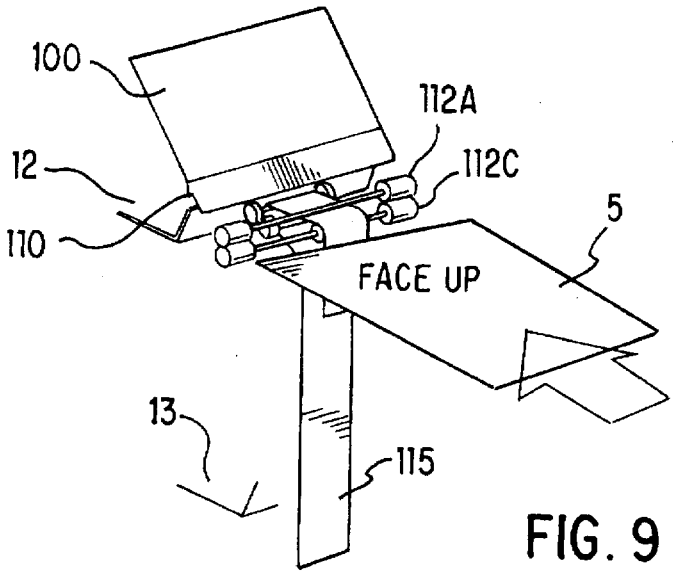
FIG. 9 provides another embodiment for the flipper portion of the present embodiment.

An alternative embodiment of flipper 11 is shown in FIG. 9. As will be described with subsequent figures, flipper 11 of FIG. 9 uses a relatively small number of mechanical components. The high level operation of flipper 11 has media 5 transported by upper feed rollers 112*a* and lower feeding rollers 112*c* such that media 5 travels up paper slider tray 100. Gravity then pulls media 5 down towards transportation belt 115.

Figure 10:
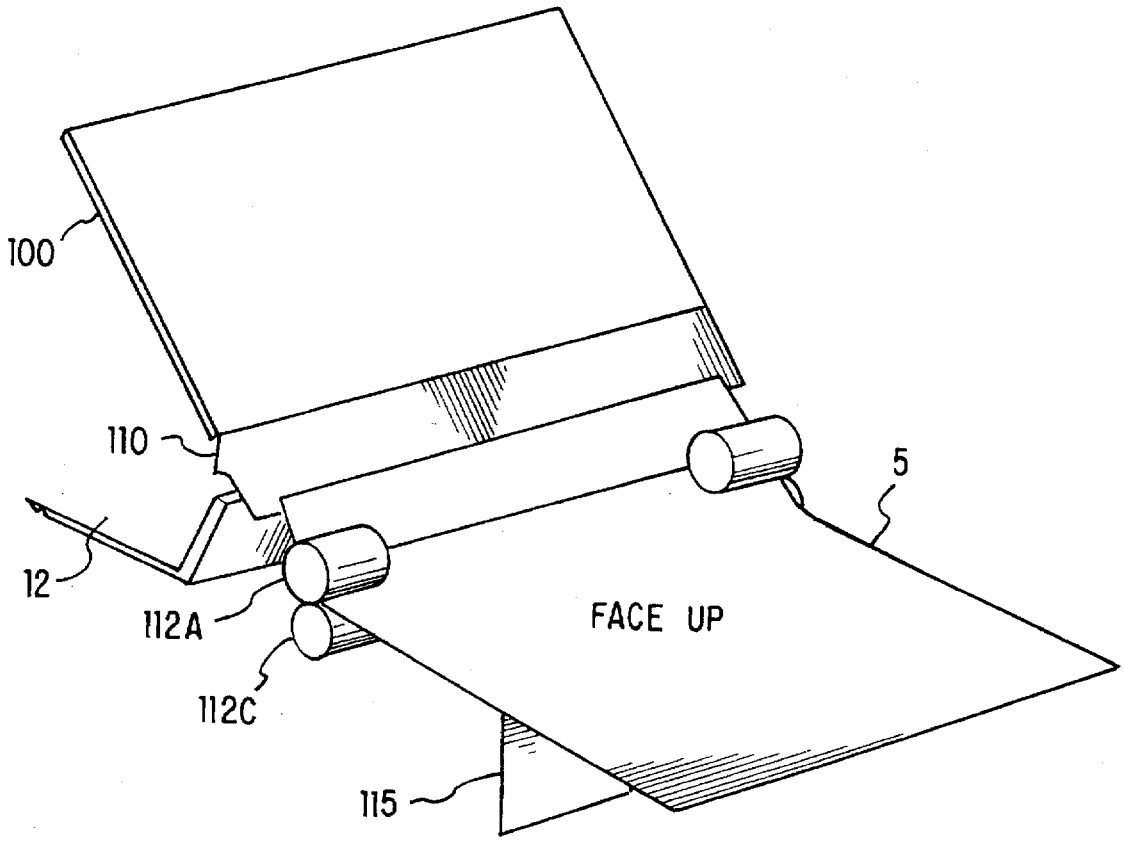
FIG. 10. shows media entering the flipper.
Figure 11:
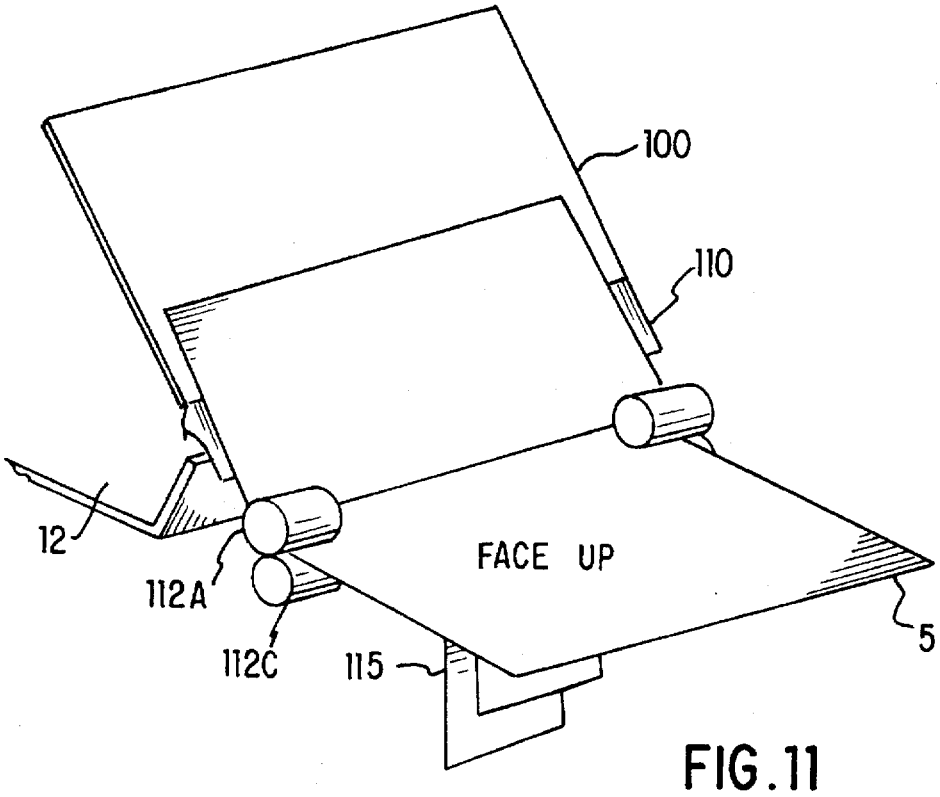
FIG. 11 shows media in the flipper.

FIG. 10 shows how upper and lower feeding rollers 112*a* and 112*c* respectively hold media 5. Because of the inclination of paper slider tray 100, upon exiting feeding rollers media 5 is guided in a generally upward direction. This result can better be seen in FIG. 11. It should be understood that at this point media 5 has not touched transportation belt 115. The feeding rollers 112*a* and 112*c* are rotated at the same linear speed as the rollers at the exit of the attached device.

Static friction between media 5 and paper slider tray 100 must be low enough to allow media 5 to slide up and down easily. Friction control is not critical during the feeding stage because feeding rollers 112*a* and 112*c* provide sufficient driving force to overcome normal friction between media 5 and paper slider tray 100. As will be understood later, friction control becomes more critical in subsequent stages.

Figure 12:
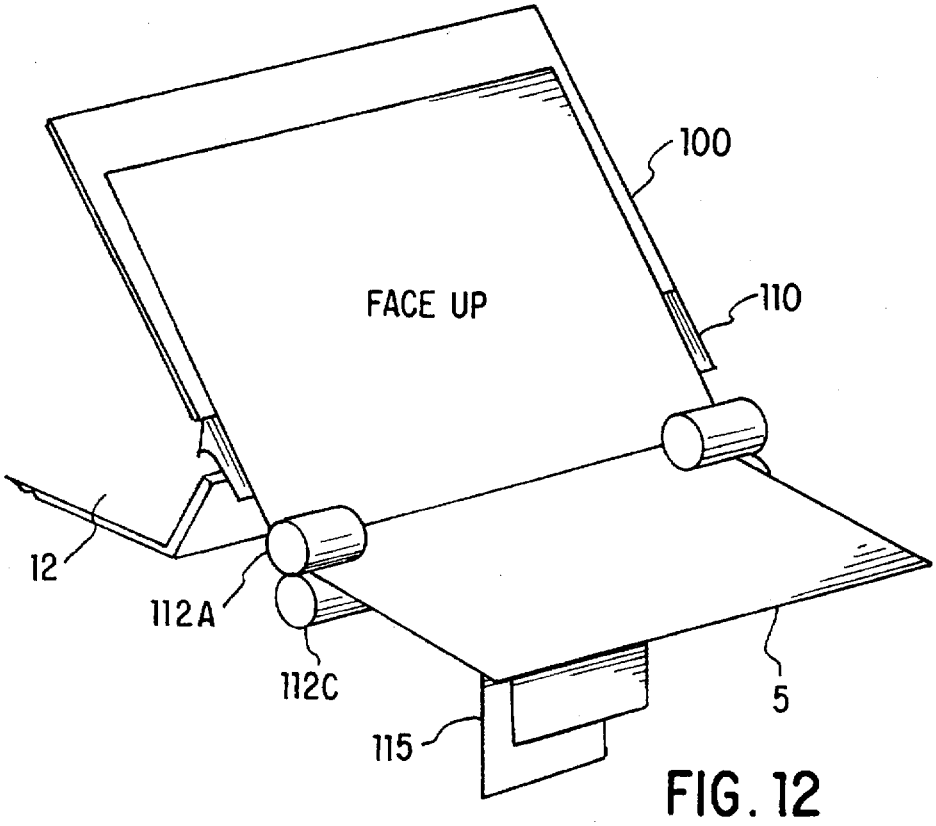
FIG. 12 shows media in the flipper.
Figure 13:
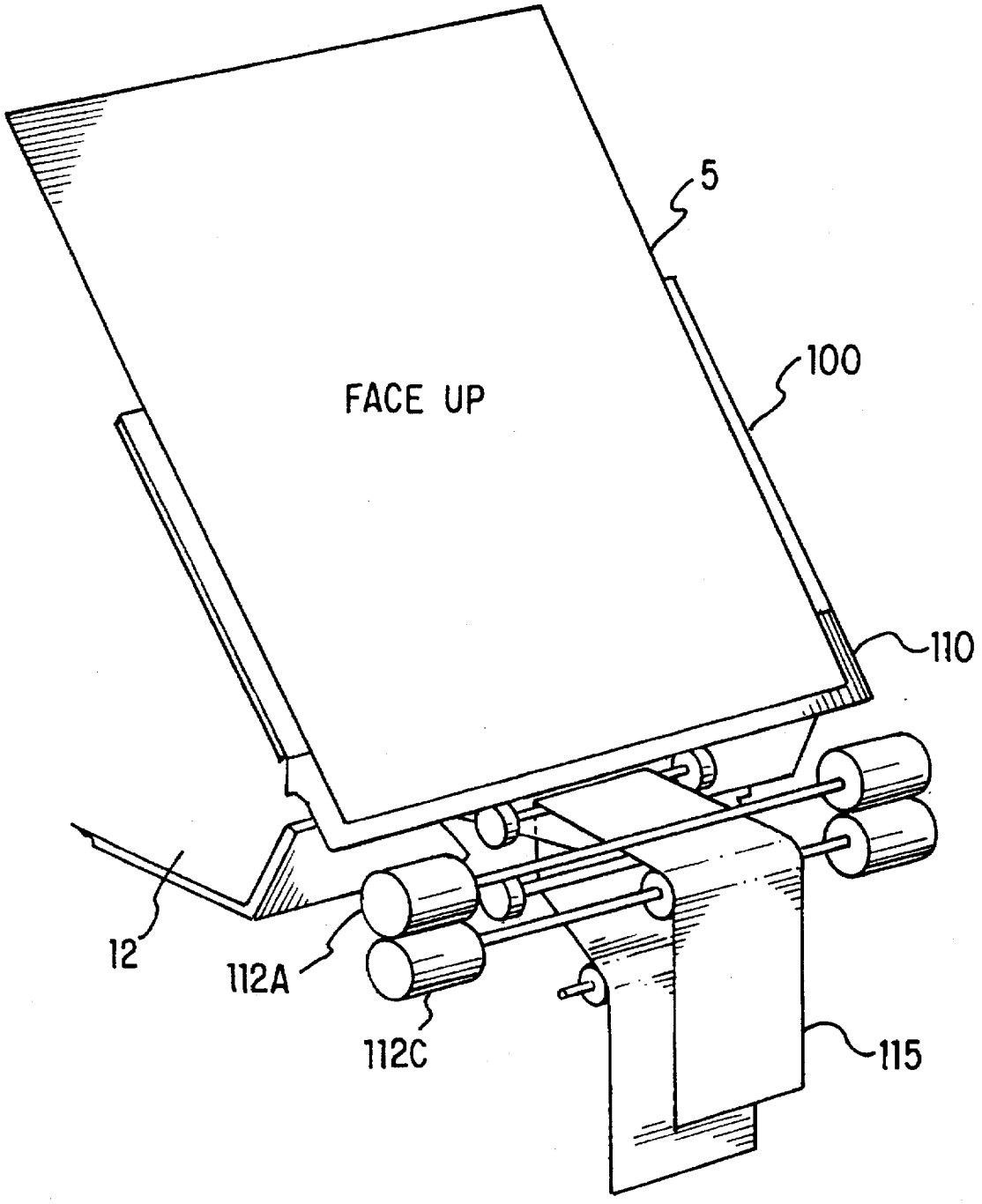
FIG. 13 shows media as it exits the feeding rollers.

In FIG. 12 media 5 has almost completed transportation between feeding rollers 112*a* and 112*c*. Referring next to FIG. 13 one sees that media 5 has completely exited the nip between feeding rollers 112*a* and 112*c*. Once feeding rollers 112*a* and 112*c* have released media 5, it is allowed to free fall on sliding tray 100. Now friction between media 5 and paper sliding tray 100 becomes critical. Operation of flipper 11 requires that media 5 travel downward merely propelled by gravitation. Thus, proper operation depends upon reduced friction between media 5 and paper sliding tray 100. Friction can be controlled several ways, for example, by proper selection of paper sliding tray 100 material as well as the angle of the paper sliding tray 100.

Figure 14:
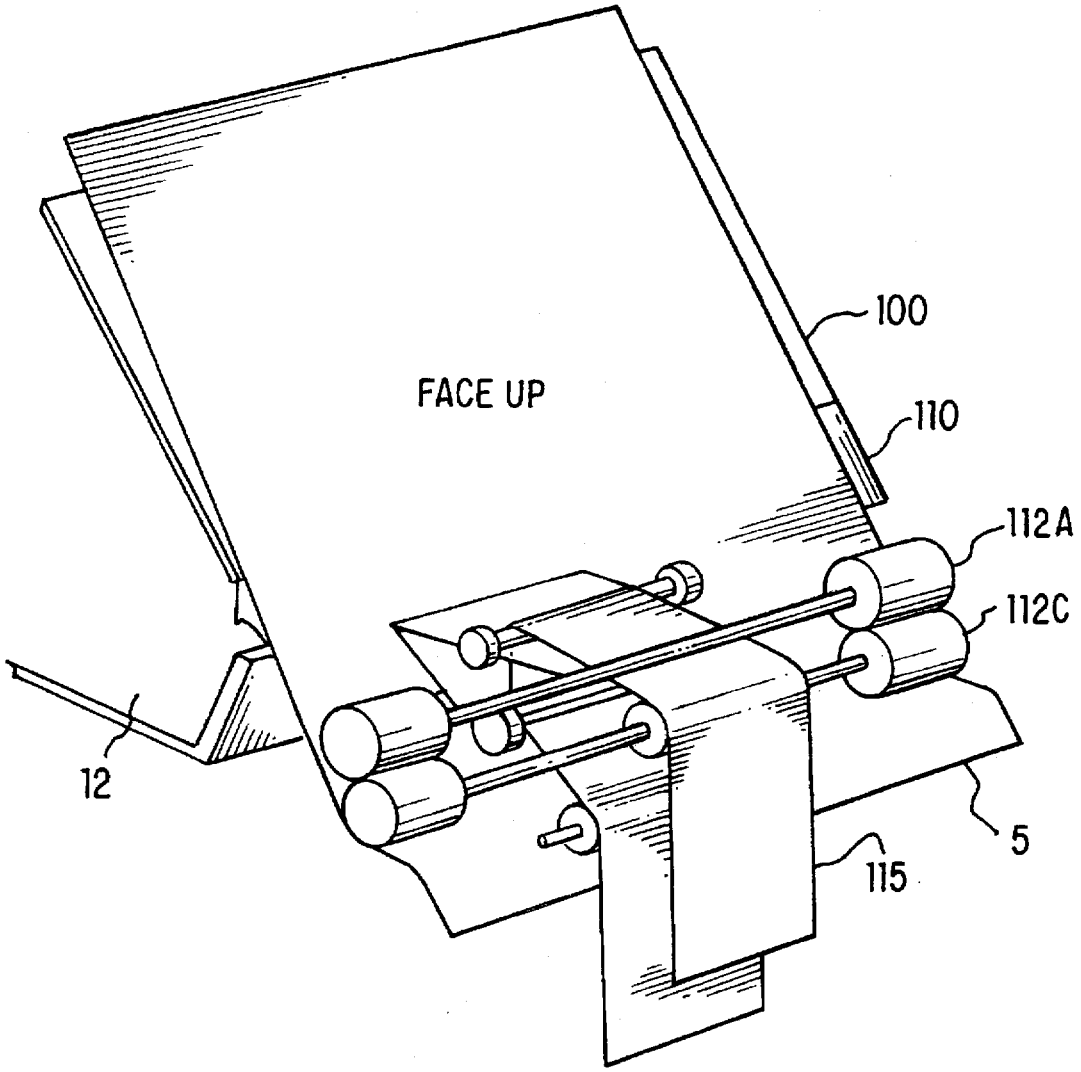
FIG. 14 shows media exiting the flipper and entering the transportation system.
Figure 15:
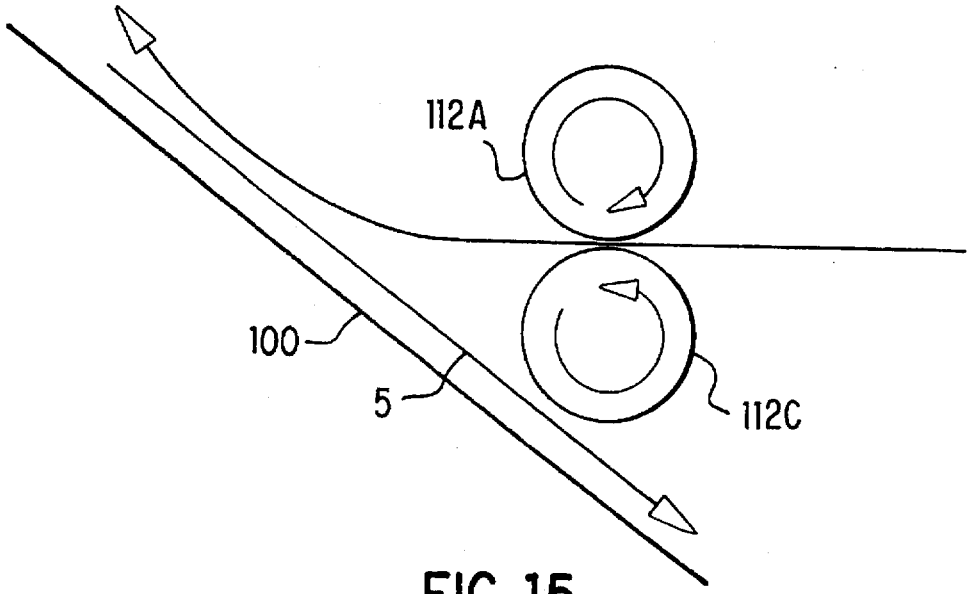
FIG. 15 provides additional detail of the relationship between the feeding rollers and the paper sliding tray.

Referring next to FIG. 14, media 5 travels down paper sliding tray 100 until it reaches lower feeding roller 112*c* or the transportation belt 115. The embodiment of flipper 11 as just described in FIGS. 9–14 is shown in a simplified format in FIG. 15. With this embodiment media 5 is transported by lower feeding roller 112*c* as it exits paper sliding tray 100. Using lower feeding roller 112*c* to remove media 5 from sliding paper tray 100 reduces the importance of proper friction control. Additionally, only one motor is required to drive both the feeding rollers and transportation belt. However, this arrangement does not allow for accelerated removal of media 5 from paper sliding tray 100.

Figure 16:
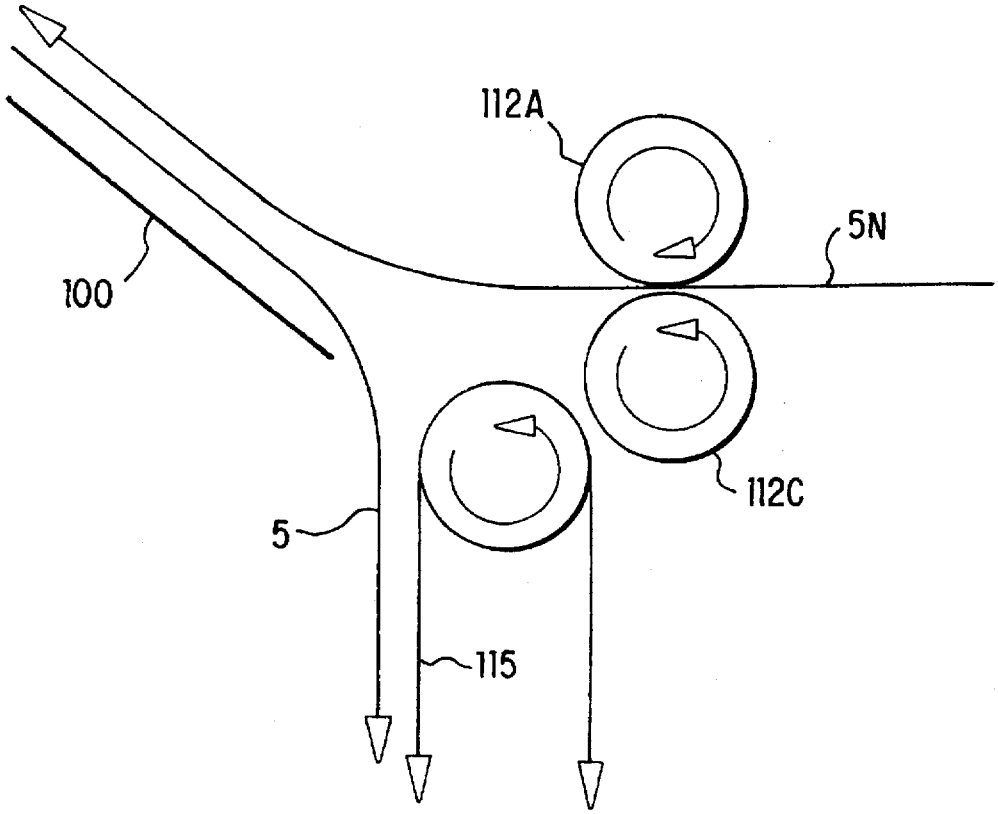
FIG. 16 shows in detail an alternative embodiment of the relationship of the feeding rollers and the paper sliding tray.

To reduce the possibility of paper jams in the flipper, it may be desirable to extract media 5 from paper sliding tray 100 before the next sheet is released from rollers 112*a* and 112*c*. FIG. 16 shows an alternative arrangement wherein media 5 is extracted from paper sliding tray 100 by transportation belt 115. The arrangement of FIG. 16 in particular allows for the accelerated extraction of media 5 from paper sliding tray 100. Thus, once media 5 is released from rollers 112*a* and 112*c*, transportation belt 115 removes it from paper sliding tray 100. Because the linear speed of transportation belt 115 is greater than that of rollers 112, media 5 is extracted from paper sliding tray 100 faster than new media 5*n* is feed into it. However, the embodiment is more sensitive to friction between media 5 and sliding paper tray 100.

Figure 17:
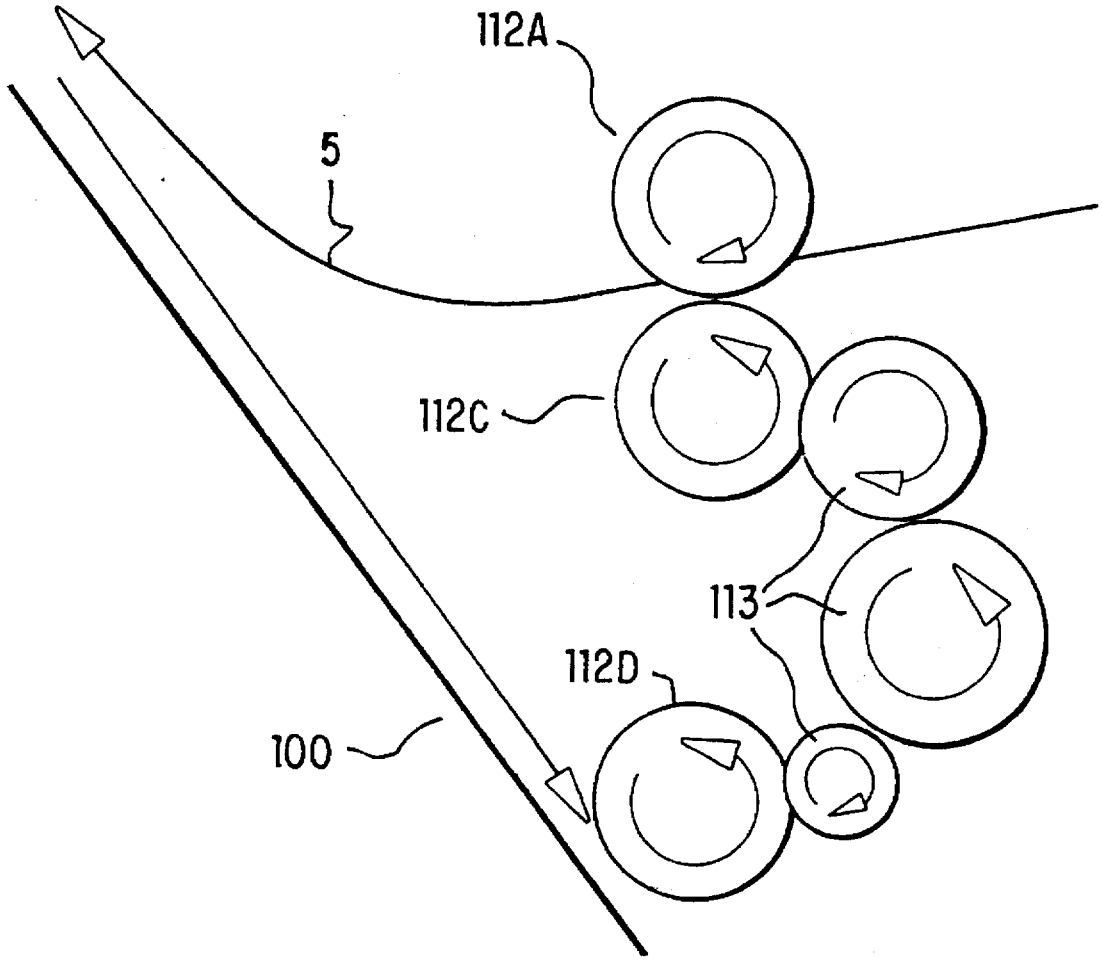
FIG. 17 provides yet another embodiment for the rollers used in the flipper.
Figure 18:
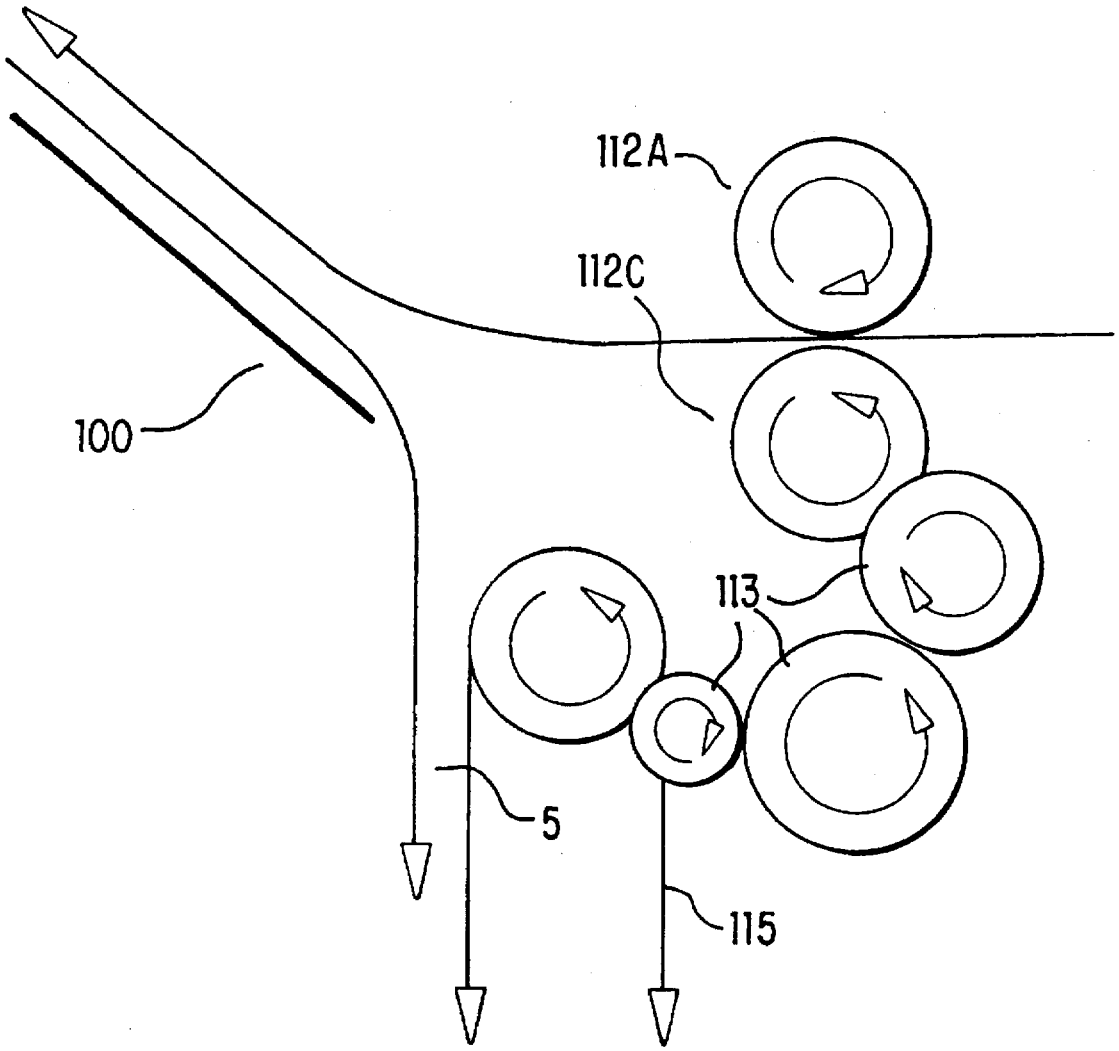
FIG. 18 shows one embodiment that allows a single motor to power both the flipper and transportation system.
Figure 19:
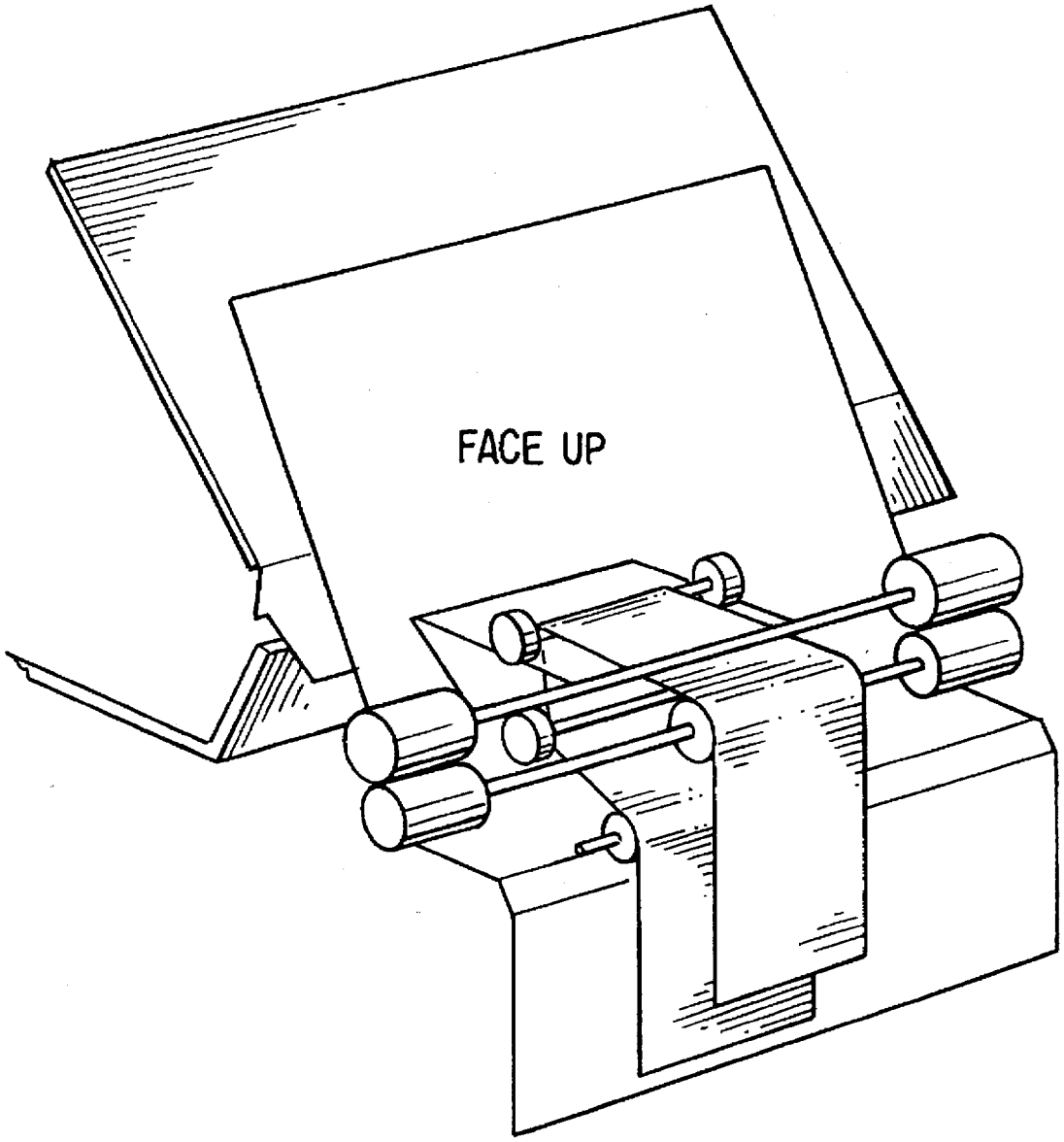
FIG. 19 shows media exiting the flipper and entering the transportation system.
Figure 20:
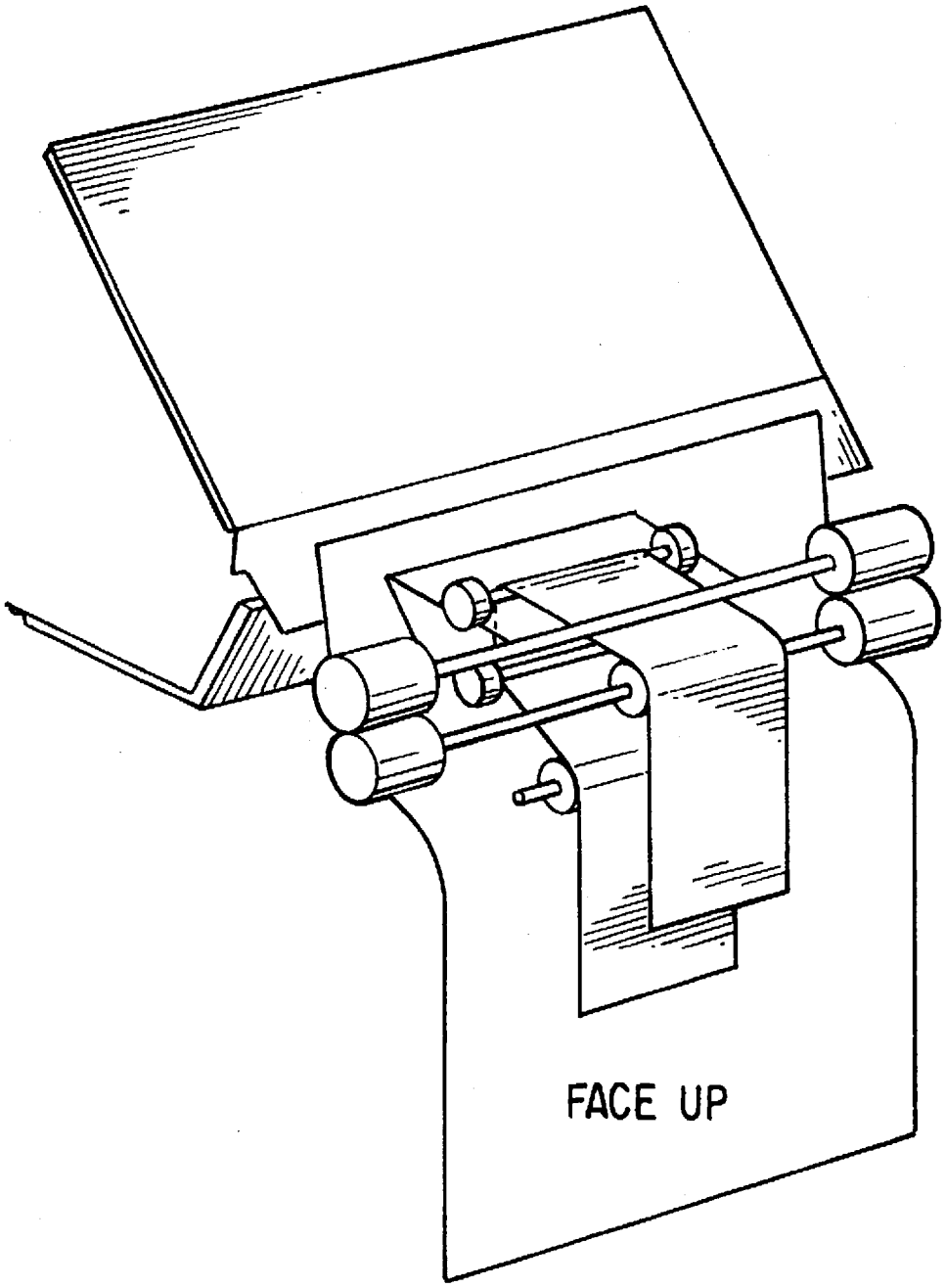
FIG. 20 shows media exiting the flipper and entering the transportation system.
Figure 21:
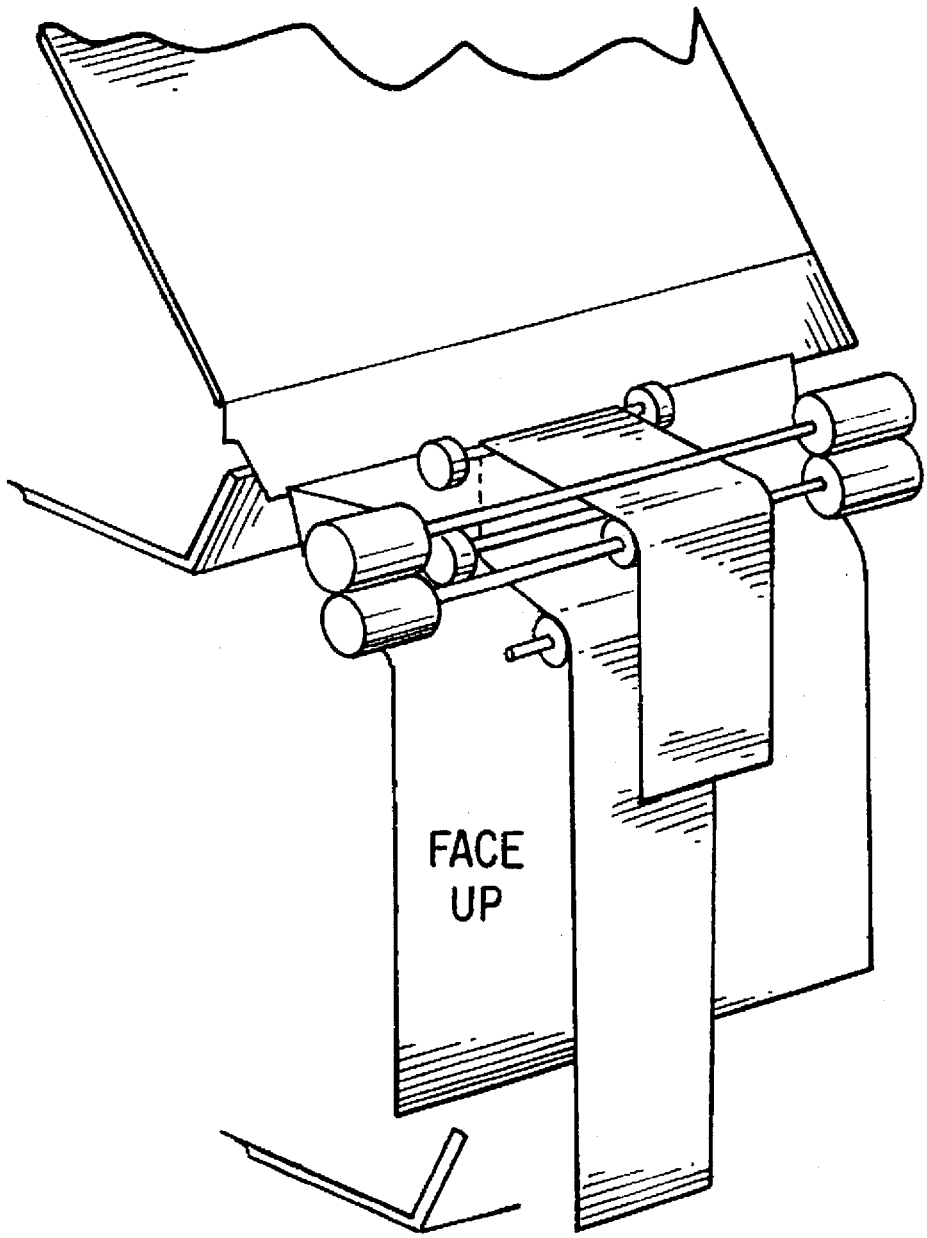
FIG. 21 shows media exiting the flipper and entering the transportation system.
Figure 22:
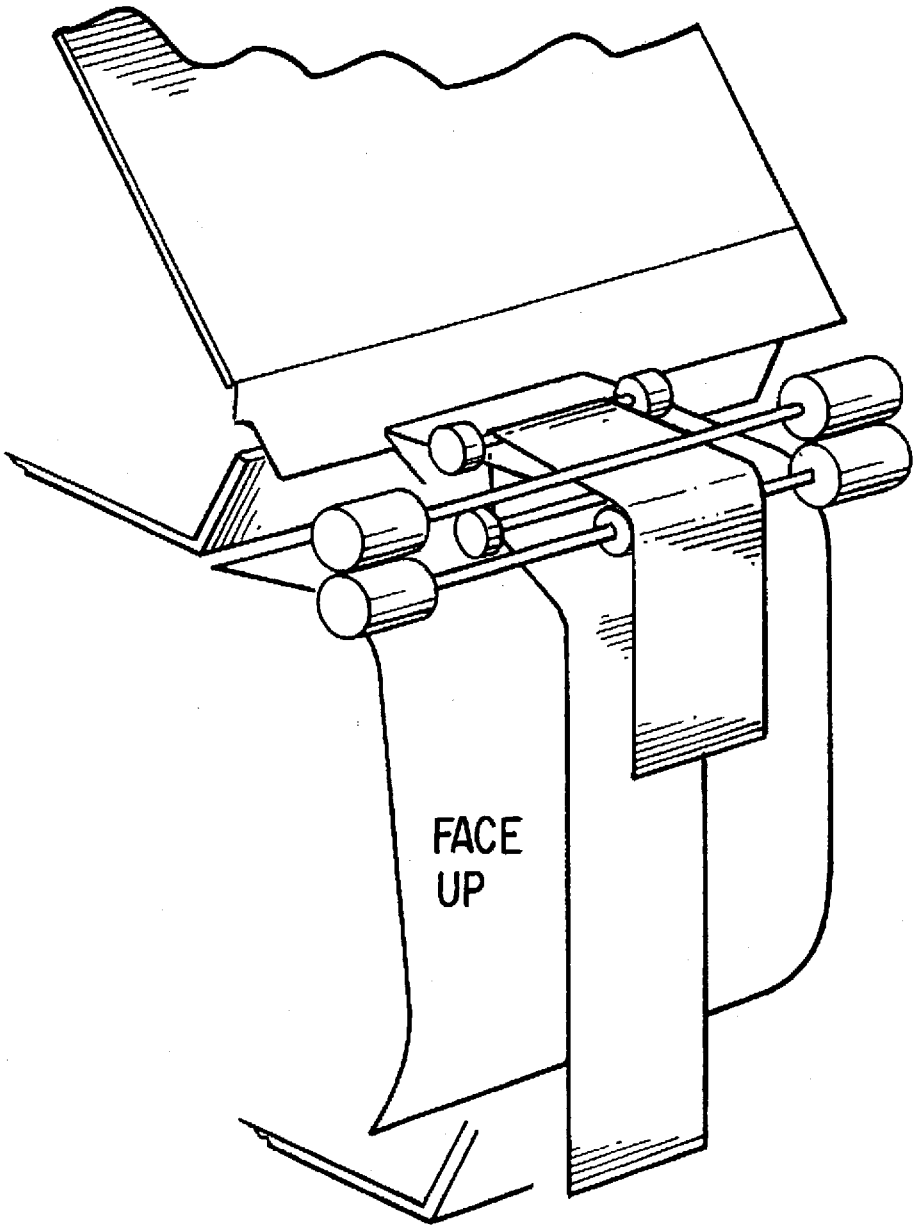
FIG. 22 shows media exiting the flipper and entering the transportation system.
Figure 23:
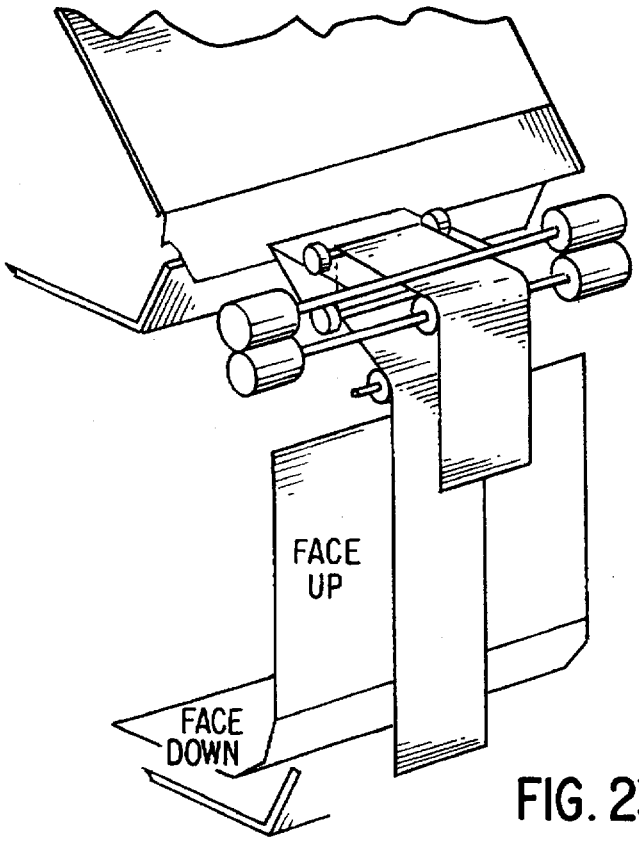
FIG. 23 shows media exiting the transportation system and being deposited in an output tray.
Figure 24:
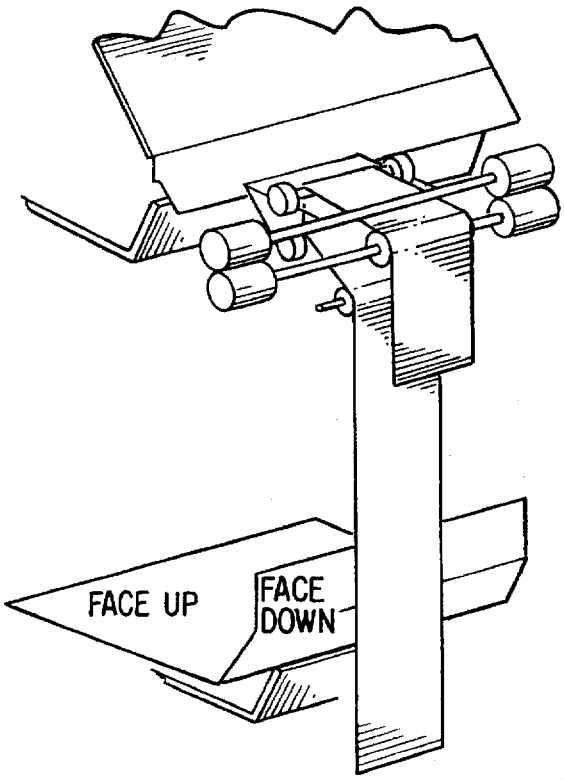
FIG. 24 shows media exiting the transportation system and being deposited in an output tray.
Figure 25:
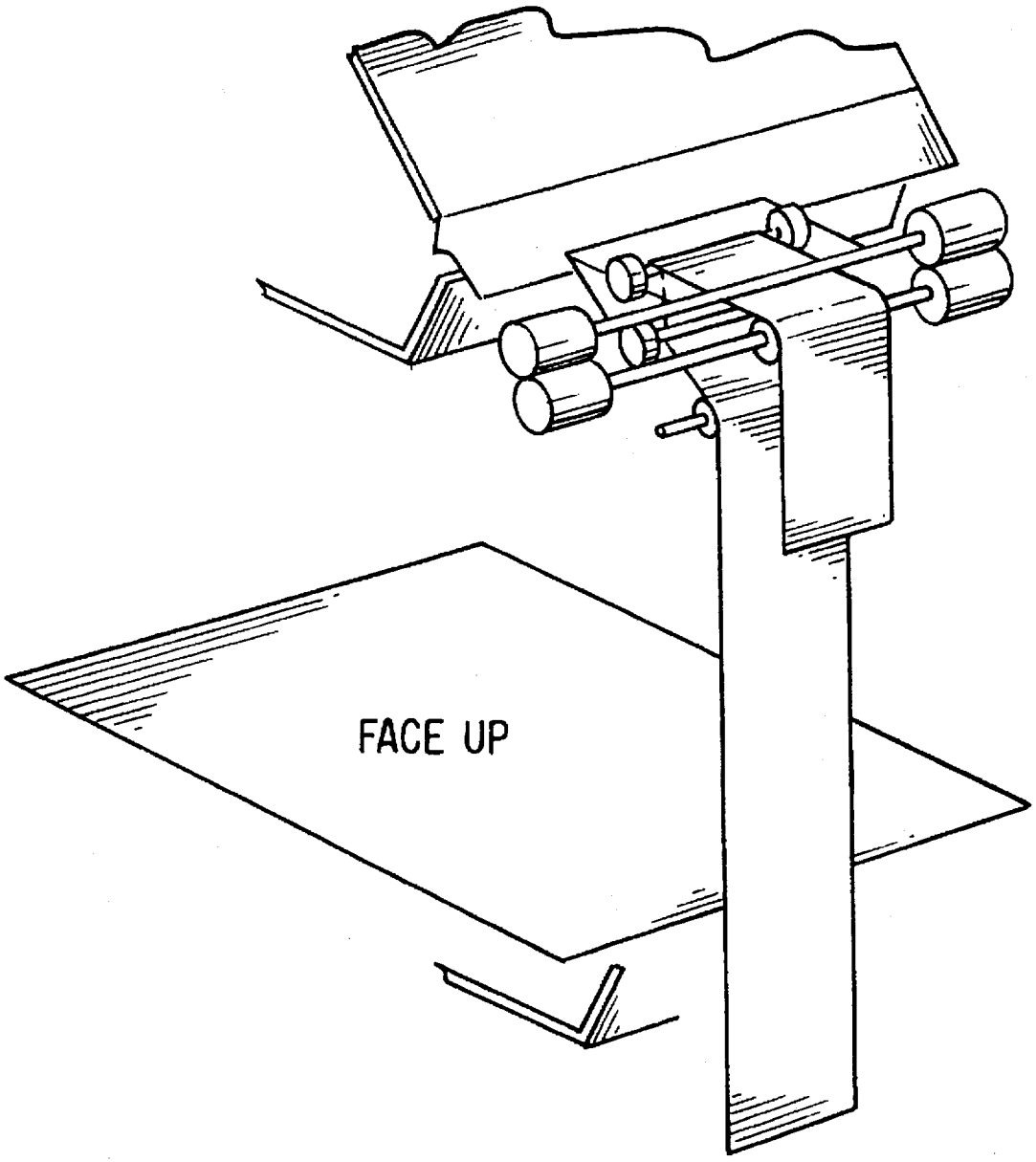
FIG. 25 shows media exiting the transportation system and being deposited in an output tray.

One skilled in the art will understand that numerous arrangements are possible to power the flipper, two such possibilities are provided in FIG. 17 and 18. In FIG. 17 an additional roller 112*d* is shown. This arrangement has the advantage of accelerated positive force extraction of media 5 from the paper sliding tray thus eliminating the disadvantage of the FIG. 16 embodiment. FIG. 18 shows details for allowing a single motor to power both the flipper and transportation system.

FIGS. 19–25 show in a simplified format the sequence of movement of media 5 until it reaches it final destination.

Although the preferred embodiment of the invention has been illustrated, and that form described, it is readily apparent to those skilled in the art that various modifications may be made therein without departing from the spirit of the invention or from the scope of the appended claims.

What is claimed is:

1. A sheet sorting apparatus for depositing a sheet in one of a plurality of output trays, comprising:

a first roller and a second roller, said first roller in driving engagement with said second roller forming a feed nip, a leading edge of said sheet enters said feed nip, said roller assembly moves said sheet until a trailing edge of said sheet exits said feed nip;

a means for driving said first roller;

a flipper tray mounted inline with said feed nip;

a continuous belt rotatable about a first pulley and a second pulley, said first pulley mounted proximately to said flipper tray so that said continuous belt removes said sheet from said flipper tray trailing edge first;

a cavity between said first pulley and said second pulley;

a permanent magnet placed in said cavity; and a magnetic tape having a first end mounted proximately to said flipper tray and a second end retractably attached to a distribution head, said magnetic tape and said continuous belt forming a channel in which said sheet travels between said feed nip and said distribution head;

said distribution head movable along said continuous belt between said first pulley and said second pulley, said distribution head positioned adjacent to said one of said plurality of output trays; and means for moving said distribution head.

2. A sheet sorting apparatus as claimed in claim 1 further comprising a deflector mounted between said feed nip and said flipper tray, said deflector having a first position and a second position, said first position deflects said sheet into a second output tray and said second position deflects said sheet into said flipper tray; and a means for moving said deflector between said first position and said second position.

3. A sheet sorting apparatus as claimed in claim 1 further comprising a timing belt being rotatable about a pair of pulleys, said distribution head comprising:

a frame;

a holding bracket attached to said timing belt and said frame;

a roller assembly rotatable mounted to said frame, said roller assembly having a nip in which said sheet moves through;

a means for driving said roller assembly; and a deflector having a curved shape formed around said second roller such that movement of said sheet is deflected from said continuous belt toward said one of a plurality of output trays.

4. A sheet sorting apparatus for directing a sheet to one of a plurality of output trays, said sheet having a first edge and a second edge, said apparatus comprising:

a movement means for moving said sheet, said movement means moves said sheet with said first edge in front;

an inverter means for inverting said sheet such that said second edge is in front;

a continuous belt wrapped around a first pulley and a second pulley forming a cavity between said first pulley and said second pulley;

a means for rotating said first pulley;

a permanent magnet placed in said cavity;

a magnetic tape having a first end mounted proximately to said inverter means and a second end retractably attached to a distribution means, said magnetic tape and said continuous belt forming a channel in which said sheet travels; and said distribution means for removing said sheet from said channel and directing said sheet into said one of said plurality of output trays.

5. A sheet sorting apparatus as claimed in claim 4 further comprising a positioner means for positioning said distribution means adjacent to said one of a plurality of output trays.

6. A sheet sorting apparatus as claimed in claim 5, wherein said distribution means comprising:

a roller assembly having a nip in which said sheet moves through;

a means for driving said roller assembly; and a second deflector means for deflecting said sheet from said transportation means toward said one of said plurality of output trays.

7. A sheet sorting apparatus as claimed in claim 6, wherein said positioner means comprising:

a timing belt being rotatable about a pair of pulleys;

a means for rotating at least on of said pair of pulleys; and a holding bracket attached to said timing belt and said distribution means.

* * * * *